US005099917A

United States Patent [19]

Roser

[11] Patent Number: 5,099,917

[45] Date of Patent: Mar. 31, 1992

[54] WATER WELL CONSTRUCTION

[76] Inventor: Kenneth P. Roser, R.D. 4, E. Floyd Rd., Rome, N.Y. 13440

[21] Appl. No.: 610,694

[22] Filed: Nov. 8, 1990

[51] Int. Cl.[5] ..... E21B 43/04

[52] U.S. Cl. ..... 166/51; 166/242

[58] Field of Search ..... 166/278, 279, 369, 380, 166/242, 51

[56] References Cited

U.S. PATENT DOCUMENTS

| | | | |
|---|---|---|---|
| 1,050,244 | 1/1913 | Smith . | |
| 1,490,280 | 4/1924 | Layne . | |
| 2,171,884 | 9/1939 | McLaine | 166/278 |
| 2,223,374 | 12/1940 | Layne | 166/278 |
| 2,312,862 | 3/1943 | Bermingham, Jr. | 166/278 |
| 2,352,832 | 7/1944 | Gunderson | 166/268 |
| 3,055,424 | 9/1962 | Allen . | |
| 3,193,005 | 7/1965 | Hunter et al. . | |
| 4,308,917 | 1/1982 | Dismukes | 166/242 X |
| 4,438,976 | 3/1984 | Baughman et al. | 299/4 |
| 4,624,319 | 11/1986 | van der Borght | 166/369 |
| 4,625,803 | 12/1986 | Walhaus et al. | 166/279 X |
| 4,669,536 | 6/1987 | Ames et al. | 166/68 |
| 4,823,826 | 4/1989 | Sacco | 166/279 X |
| 4,850,428 | 7/1989 | Paulus | 166/85 X |

*Primary Examiner*—William P. Neuder
*Attorney, Agent, or Firm*—Wall and Roehrig

[57] ABSTRACT

A shallow well installation that can be quickly, easily and economically installed and sealed against surface contamination is provided by a continuous plastic pipe well casing extending from ground level to the foot of the well surrounded by a filtration aggregate such as #4 stone and which is sealed by plastic film and/or elastic concrete on top of the stone. The stone extends approximately 18 inches above the water table. A plastic pipe seal and lock are placed at the top of the well casing. A water supply pipe is provided to the house through the side wall of the plastic well casing and, a small plastic pipe is installed outside the well casing within the stone surrounding the plastic well casing extending to the foot for water treatment purposes. The entire well casing installation can be installed in a freshly dug hole or can be used to renovate an existing shallow well casing to upgrade the sanitary rating and to insure against further surface contamination.

3 Claims, 3 Drawing Sheets

WATER WELL CONSTRUCTION

BACKGROUND OF THE INVENTION

This invention relates to water wells, and more particularly to a method of construction for shallow water wells of the type usually classified as dug wells.

For many years, in high water table areas, it has been common practice to construct a well by digging a hole to a depth of fifteen to thirty feet and then positioning in the hole typical concrete pipe sections of two to four feet in diameter and two to four feet in length, one on top of the other to form a well casing from the bottom of the hole to the surface of the surrounding ground. After tiles have been laid up, usually dry, one on top of the other, the well is back filled around the tiles to fill the hole back in, and water is allowed to seep in through the cracks between the tiles and through any breaks in the tiles themselves, as well as to seep up from the bottom of the casing to form a reservoir of water. In the usual well of this type, pipe is extended down into the well with a foot valve at the bottom, and it is connected to a pump located usually in the basement of the house that the well serves. The pump may sometimes be a submersible pump actually positioned in the bottom of the well casing and then connected by pipe to a pressure/expansion tank in the house to be served. Waterwells have generally consisted of three types in common usage over the last several decades. A first type has been the drilled well in which material is actually bored out of the ground and a pipe liner is lowered down as the bit progresses so that the well bore is fully lined all the way through down into rock and so forth. This type of well generally has required a steel or metal pipe bore liner which forms a well casing into which is inserted the submersible pump for withdrawing water therefrom. A second type of well has been the so-called driven type of well in which a steel pipe is driven into the ground and then the dirt or material inside the pipe is mixed with water and stirred up and pumped out of the steel pipe to form an open well casing for insertion of the submersible pump to withdraw the water. The driven well generally, however, is not extended down through rock, and the metal pipe well casing usually stops at any rock formation found. The third type of well construction in general use is the excavated or dug type of well in which a back hoe, or other type of digger is used to dig a relatively large hole on the order of ten to fifteen feet across to a desired depth and then the well casing is lowered into the hole. After the entire hole has been dug to the desired depth. Generally speaking, the drilled or driven well is used for deep wells of one hundred feet or more while the dug or excavated well is preferable in shallower type wells, in the range of 30 feet to 40 feet.

This latter type construction has been used for a number of years because the materials were readily available and it was relatively easy to dig a hole with a common backhoe or similar type of machine and to place the tiles in the hole. This procedure, however, has been somewhat hazardous in that the cement tiles can be very heavy and awkward to install and the people installing them must be skilled in handling bulky heavy articles and in properly aligning them so that they perform their intended function. Also, cement tiles have, on occasion, had the limitation of leaching lime into the water in the well, as well as iron from the reinforcing steel found in certain of the tiles. In addition, wells of this type have progressively become more expensive to construct due to the increased cost of the tile and the need for heavy equipment to dig the hole and install the tile.

Finally, it has also been found that over the years cement tile and other type of tile well casings have been subject to displacement by frost heaving and to attack by worms and other organisms within the dirt surrounding the well in which, particularly during dry time, they seek water and they form small holes leading into the well casing through cracks, voids in the concrete, and so forth, all of which form avenues of access for contaminants of one kind or another. Frequently, worms and other small animals will find their way into the well only to fall to the bottom and then cannot get out and accordingly pollute the well water, as far as human consumption is concerned.

According to the present invention, by providing a smooth heavy walled plastic well casing of ABS or rigid PVC, I have eliminated any possibility of contamination entering through the well casing since this type of plastic is essentially impervious to attack by worms and other small animals, and it is possible with the plastic pipe to provide sealed joints and caps so that there are no longer the apertures common in the old-fashioned, homemade well constructions in which small animals, worms, and other similar organisms can gain entry to the interior of the well casing. This impervious well casing can also be sealed about the upper end of any filtering media, such as washed stone, to further inhibit entrance of surface water down around the outside of the well casing to eventually contaminate the water within the well casing. Also, by limiting the access to the water to be drawn for use to the very bottom of the well casing, the purist and least likely to be contaminated water is drawn from the source of water in the water table. The smooth wall of the plastic pipe also tends to minimize, if not eliminate, any displacement or heaving of the well casing due to frost or other ground movement. Also, the smooth plastic well tile casing permits, after installation, subsequent deepening of the well by merely digging out, by auger, or otherwise the interior of the well, and sliding the well casing deeper, sealing another length of plastic pipe, if necessary, to the top length previously capped. This has not been possible with other types of well casings, to the best of applicant's knowledge.

OBJECTS AND SUMMARY OF THE INVENTION

Accordingly, it is an object of the present invention to provide a well construction that overcomes the deficiencies of previously available well constructions.

It is another object of the present invention to provide a continuous well casing that can be quickly and easily installed in a hole for forming a water well casing.

It is another object of the present invention to provide a plastic pipe of extended length for use as a well casing to provide an easily sealed well construction that keeps out unwanted ground water contamination while permitting easy access to filtered below-ground water.

It is a further object of the present invention to provide a well casing for dug wells in which no heavy machinery is required to install the well casing, water pipe and pump mechanisms.

It is yet a further object of the present invention to provide a well casing that can be installed with much greater safety and less risk of harm to the installers and that can be readily and easily sealed at the surface against entry of contaminating ground water.

The foregoing objects of this invention are achieved in a particular embodiment by the provision of a long length of plastic pipe having small holes perforated therethrough at the bottom and extending from the bottom of the well to the surface of the surrounding ground with no more than one sealed joint and with the plastic pipe being surrounded with washed stone filling the well bore or hole outside of the pipe to support the pipe therein. Small holes are drilled in the bottom 6" to 12" of the pipe. The stone acts as a purifying filter for the water as it is drawn into the well casing and the plastic pipe acts to seal out all unwanted contamination, while allowing easy access for insertion of a foot valve or submersible pump, as the case may be, for pumping water therefrom.

BRIEF DESCRIPTION OF THE DRAWINGS

Further objects of the invention and additional features and advantages thereof will be apparent by reference to the following description and the accompanying drawings wherein.

DESCRIPTION OF THE PREFERRED EMBODIMENT

Figure 1:
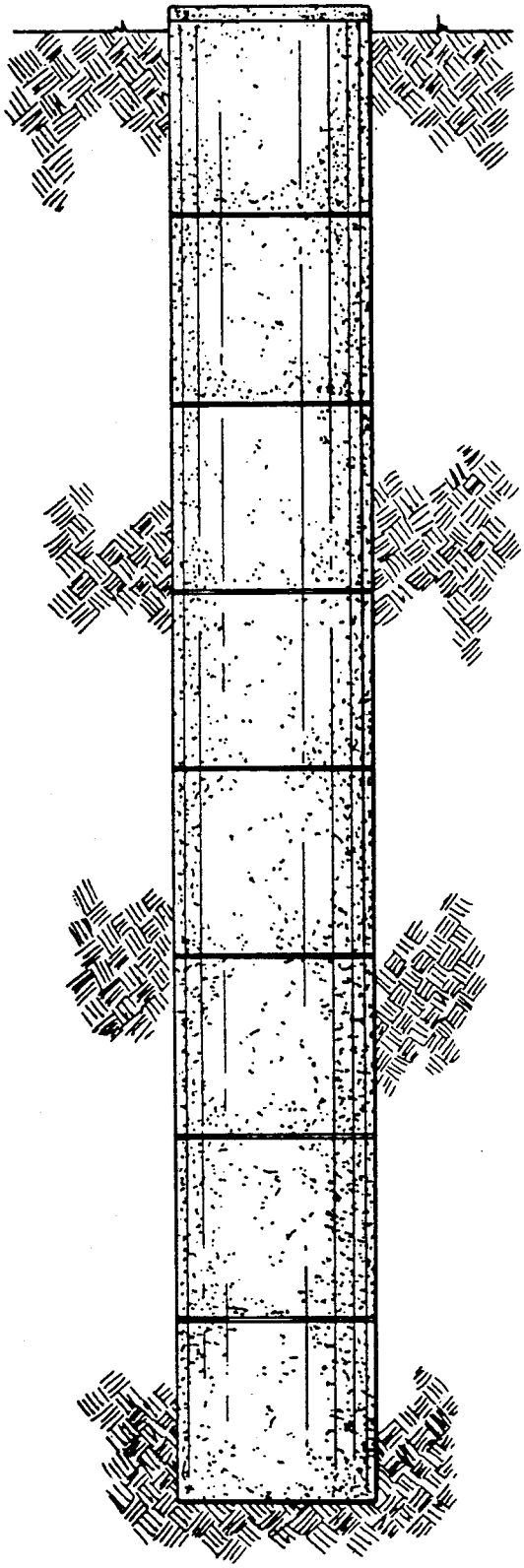
FIG. 1 PRIOR ART
FIG. 1 is a cross sectional view, partially diagrammatic of a prior art cement tile well.

Referring now to FIG. 1, there is shown a typical well installation according to the prior art. In the prior art a hole is dug down to well below the water table to a maximum depth of about 30 feet. The holes have generally been lined with hand laid up field stone or, in more recent years, concrete tiles of two to four foot diameter and two to four foot length. The tiles have been placed in the hole and laid one on top of the other so that as shown in FIG. 1, seven or eight 4'(four foot) tiles would form a well. The bottom tile is usually placed in gravel and sometimes has holes drilled in it to permit infiltration of water from the surrounding water table into the interior of the tile. Concrete tiles form a well casing which usually fills up rather quickly with water to the level of the water table in the surrounding area. The hole has then been back filled around the tiles, usually with dirt or occasionally with crushed stone and a cover of metal or concrete is applied over the top of the upper tile to form a well head. Suitable pipe for drawing water from the well casing is then inserted with either a foot valve or a submersible pump at the foot thereof and the pipe then led through the side wall of one of the tiles into the house or other place where the water is to be used.

This type of construction has been used for many years and has generally served its purpose. Several limitations of this construction, however, have come to be serious obstacles to the construction of new wells of this type. Specifically, the tiles of this type are very heavy, require large holes to be dug, require heavy equipment to place the tiles in the hole, and usually require that a person be stationed in the hole to unhook and position the tiles. This is a rather hazardous requirement and is completely eliminated with the present invention, as will be described in detail herein. Also, the concrete tiles needed to provide an economical casing of sufficient strength to withstand backfilling of the installation, tend to leech lime into the well creating hard water for use in the home and also after passage of time, the steel reinforcing in the tile tends to leach iron into the well from rusting of the tile reinforcement rods. Also, since the tiles are normally laid dry, one on top of the other, there is no seal between the sections, and any ground water getting into the hole can seep into the water which tend to contaminate water within the well casing.

Figure 2:
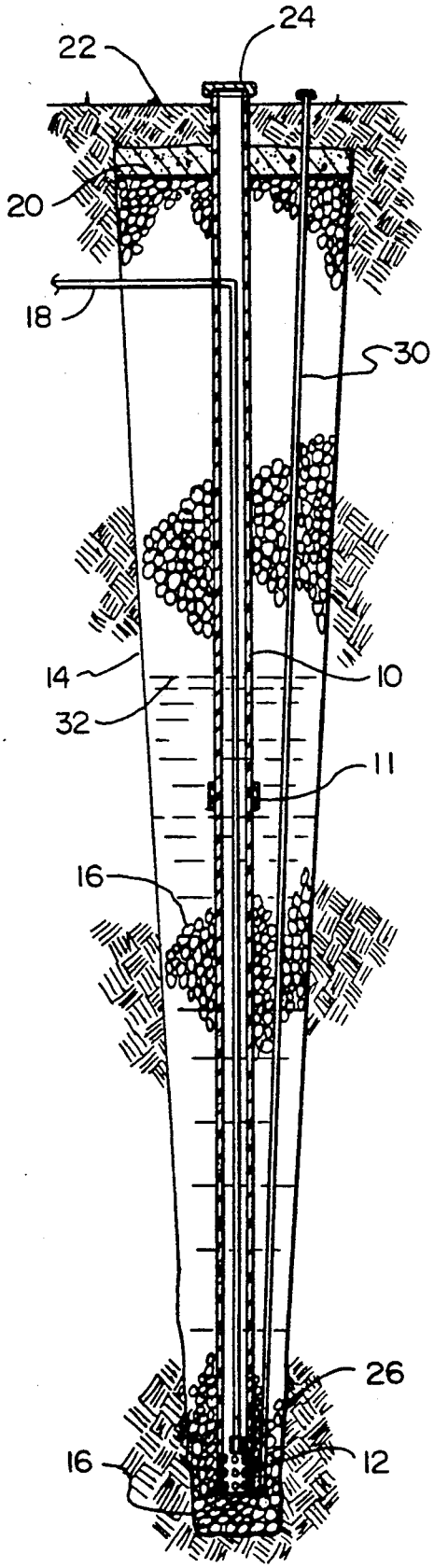
FIG. 2 is a view similar to FIG. 1 of the improved well construction in accordance with the present invention.
Figure 6:
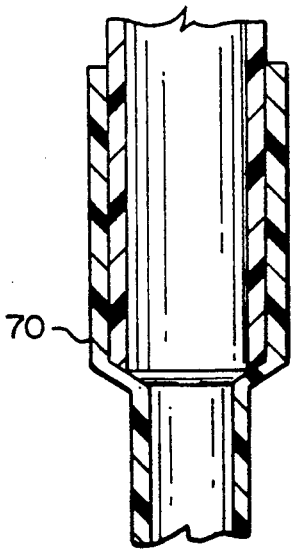
FIG. 6 is an enlarged view of the well casing joint.

Referring now to FIG. 2, there is shown a well installation according to the present invention. The well installation, according to the present invention includes an excavated or dug well bore 11 having therein a plastic well casing 10, which consists of a continuous length of heavy plastic pipe, having a diameter of some six inches and a wall thickness of one-quarter to one-half inch. Any suitable plastic such as ABS, rigid PVC or other relatively smooth water and worm impervious material may be used. The tile is generally extruded in fifteen foot lengths and for a thirty foot well, two lengths would be used. The two lengths are sealed together at the joint 11 to form a continuous length of plastic tile. The joint is shown in FIG. 6 and consists generally of an elongated bell section 70 at the top of the lower pipe section which receives the end of the upper pipe in a tight sliding fit. The bottom periphery of the upper section is chamfered to match the shoulder of the bell 70 to provide further sealing. Also, the length of the bell is extended some six inches over a standard pipe connection to allow for inadvertent movement of one length relative to the other by frost action or other means and still maintain the seal.

At the bottom of the plastic tile casing 10, a series of small water holes 12 are drilled about the circumference to increase filtration of the ground water into the well casing. The well casing is set in a layer of gravel so that the water can infiltrate through the bottom of the plastic pipe 10 as well as through the holes 12. The pipe 10 is placed in a well bore 14 which can be a dug hole or an auger drilled hole in the ground to the appropriate depth, generally a maximum of thirty feet for usual externally pumped wells of today's technology.

It should be understood that the present invention relates primarily to the shallow well type of installation in which the well bore is excavated or "dug" generally to a depth of less than one-hundred feet and in which a foot valve is provided in the well at the foot of the water drawing pipe and a suction pump is provided usually inside the house at the upper end for drawing water from the bottom of the well. A submersible pump can be used if desired and is required with wells generally deeper than thirty feet. The deep well construction is a totally different type of well in which a deep hole is drilled and steel pipe casing is used to guide the drill and line the hole to prevent cave-ins and to permit insertion later on of a deep well submersible pump at the foot of the well, when water is found. This technology is considerably different, and the problems encountered are quite different from those encountered in the shallow well type of installation. The shallow well installation obviously, where possible, is a much cheaper and yet very satisfactory solution to the problem of obtaining water for the usual household and other uses.

Figure 5:
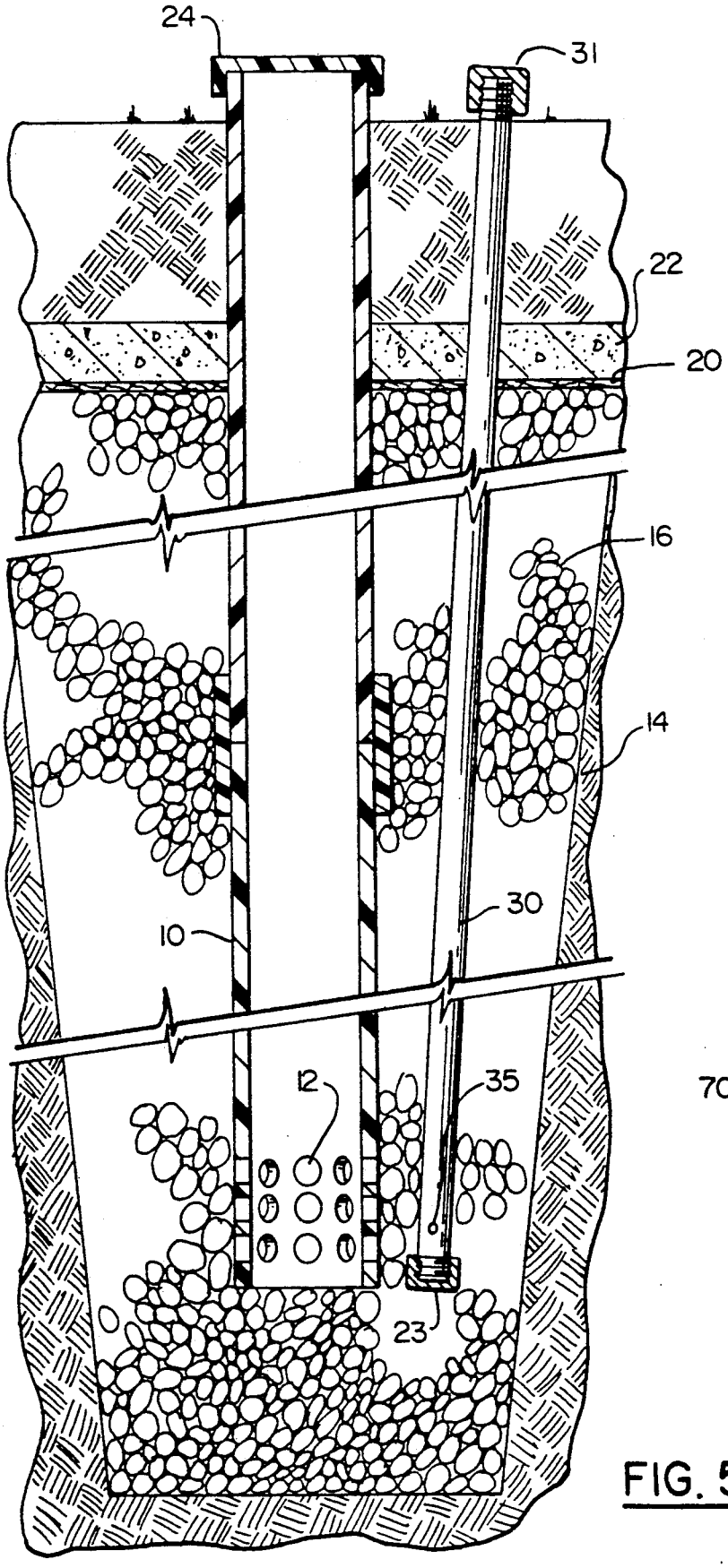
FIG. 5 is an enlarged detail of the cap and joints of the well casing.

The bore 14 of the dug well is generally several feet in diameter and is dug down to well below the water level so as to insure a good supply of water. The one or two lengths of plastic tile 10 can then be easily positioned in the hole from above without the necessity of a workman being lowered into the hole and in fact, the two lengths of pipe can be installed usually by a single person. The pipe is usually positioned in the center of the hole and the hole is then filled with washed stone 16, such as #4 treated washed stone, all around the tile 10 to fill the bore 14 and to support the pipe at in the center. The washed stone extends from below the foot of the well up to approximately eighteen inches above the ground water level, as shown in FIGS. 2 and 5. This washed stone 16 serves not only to support the tile casing 10 within the well, but it also forms a reservoir for filtering water from the ground water table as it is drawn through the bottom of the casing 10 and the holes 12. The top of the stone 16 may be covered with a plastic sealing membrane 20. The top of the bore is then sealed with elastic concrete material 22 to seal the top of the well against entrance of surface water or other surface contamination. A layer of two or more inches is usually sufficient. The bore is then filled to ground level with dirt. The top of the well casing 10 is sealed with a plastic cover 24, which is usually provided with a lock to prevent unwanted entry into the casing. The cap 24, of course, can be removed when desired to permit access to the interior of the casing 10. While the casing 10 in FIG. 2 is shown and described as six inches in diameter, other sizes of pipe can be used, depending on the volume of water needed. In some installations, a diameter of three to four feet has been found desirable. A small pipe 18 is positioned in the casing 10 to extend from the bottom to an exit point in the side wall about 3-5 feet below grade depending on the frost line. A foot valve 26 is usually fixed to the bottom of pipe 18 and the top end extends into the house or other location where the water is to be used.

In addition to the small plastic pipe 18 for drawing water from the well to the house, there is provided a second small plastic pipe 30 positioned outside of the main plastic well casing 10 and extending from ground level down to adjacent the foot of the casing 10. This pipe is provided to allow access to the water in the well casing for water treatment purposes and extends from the foot to above ground level and is capped at 31 to prevent entrance of unwanted materials. The second pipe 30 is usually provided with a cap 33 at the bottom and small hole 35 is drilled through the pipe from one side to the other to permit a controlled flow of water through the bottom of the pipe (See FIG. 5). It is thus possible to insert water treatment materials in the pipe and to have them in effect "metered" into the well, depending upon the volume of water drawn from the well casing. In operation, water softening materials, purification materials or other chemicals can be introduced through the pipe 30, as desired to treat the particular water found at the location of the well. In a preferred embodiment, a four inch long by three-eighths inch diameter rod of slow release material having a combination of chlorine, wetting agent, binder and release control agents has been found to provide bacteria killing capability for over a year in a typical well.

The rod being positioned outside the well casing, but yet within the water table, releases the chemicals slowly as the water is drawn into the casing through the holes 12 and through holes in pipe 30. If the chemicals are placed directly in the well casing, they tend to dissolve too fast and are prematurely exhausted.

There is thus provided an economical, simple to install and easy to operate shallow well for domestic water purposes in which the entire installation can be accomplished with minimum risk to the workmen and in a very short period of time. Its construction permits use of existing, readily available equipment, such as backhoes and earth augers that are frequently available with existing construction equipment. With the sealed well casing formed by the plastic pipe 10 sealed at the only joint necessary, a secure well construction is provided that minimizes the chances of any kind of surface contamination getting into the water supply from the well installation. The water level 32 in the well casing 10 is determined, of course, by the ground water level in the water table in the area in which the well installation is placed, and the direct infiltration is filtered through the stone 16 surrounding the well casing and underneath the foot of the well casing so as to provide as pure water as is possible from the water table ground water surrounding the installation. With the top of the well being sealed, contamination from the surface and the surrounding earth (i.e., worms, grubs, etc.) is essentially eliminated.

Figure 3:
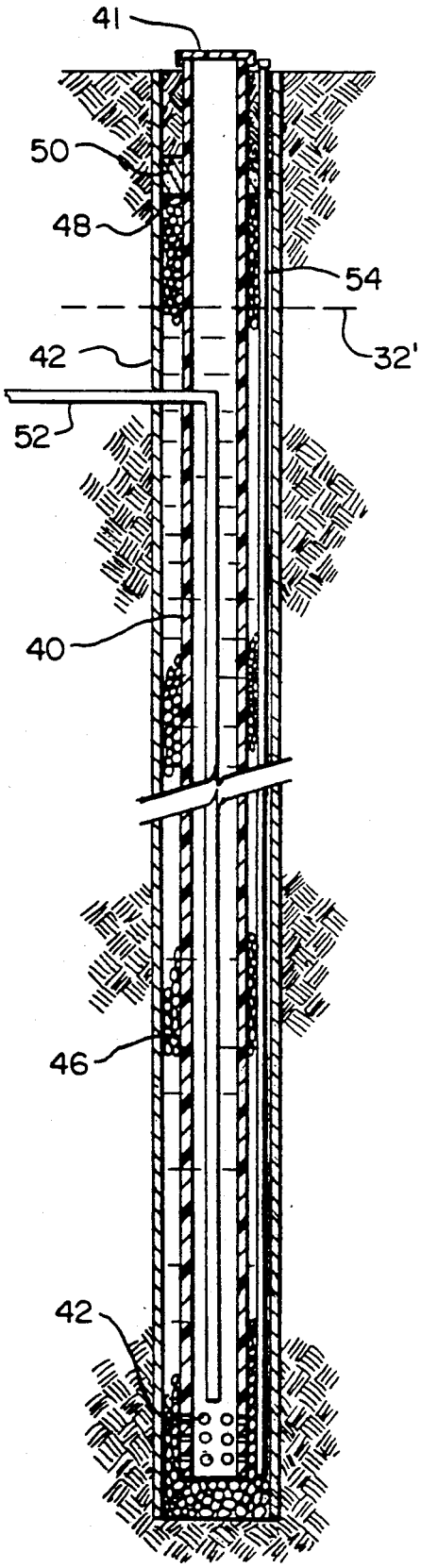
FIG. 3 is a view similar to FIG. 2 of another embodiment of the present invention.

In addition to the advantages of the present invention indicated above, there is shown in FIG. 3 another advantage of this type of installation, namely a well casing 40 formed from a plastic pipe, again of the approximately fifteen foot length, which is chosen with a diameter smaller than the diameter of an existing, previously installed well casing 42. The casing 42 can be an old iron casing from an earlier well installation and the plastic casing 40, again with water holes 42 drilled in the bottom six to twelve inches thereof, can be lowered into the existing steel well casing 42 and supported therein by the introduction of finer washed stone, such as #2 treated stone between the old well casing and the new plastic casing. The plastic casing is thus centered and supported within the old well casing and the #2 stone will act as a water filtration medium for water in the old casing from the surrounding water table, through the bottom of the plastic tile and the holes 42.

The stone 46 fills the old well casing to a depth approximately eighteen inches above the water table as in FIG. 2. At this point, a seal 48, usually a plastic membrane is inserted to seal off the top of the stone 46 an elastic concrete layer 50 to seal the top of the well is applied and then the balance of the well core bore is filled with dirt. The plastic pipe 40 has a similar plastic cap 41 with suitable lock to close the top of the well casing 40, as described in connection with FIG. 2 configuration. Again, the small plastic water-drawing pipe 52 is provided for withdrawing water from the well and an auxiliary plastic pipe 54 can be provided for applying chemical treatment, as indicated in connection with FIG. 2.

It is thus an easy and economical job to renovate an old well by use of the present well construction with the simple insertion of the appropriate diameter plastic well casing 40 and the filling and sealing with filtration material and insertion of the necessary new plastic pipe for withdrawing water from the foot of the well and for treating of the water, if desired.

Figure 4:
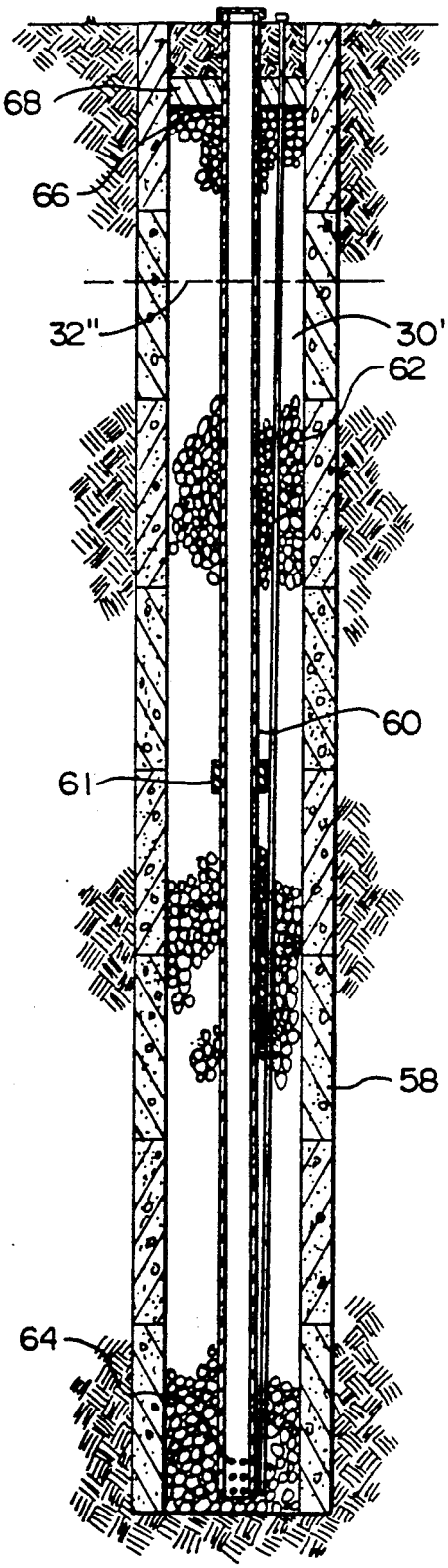
FIG. 4 is a view similar to FIG. 3 of still another embodiment of the present invention.

Referring now to FIG. 4 there is shown another embodiment of the present invention in which the standard old concrete tile well casing of, for instance, eight four foot long by four foot diameter tiles are placed in the ground, one on top of the other. As previously pointed out, the joints between the tiles are unsealed and the well installation is quite susceptible to surface water contamination. According to the present invention, a plastic well casing pipe 60 is inserted in the concrete well tiles 58 and then the interior of the concrete tiles is filled with a treated filter stone material 62, up to a level approximately eighteen inches above the water table 32". Casing 60 generally has a diameter of one to two feet in this embodiment. The well casing 60 has the usual water holes 64 spaced around the foot for introduction of water to be drawn from the well. The casing being completely enclosed in stone material 62 provides filtration of the water from the ground water table and seals out any unwanted surface penetration as described in detail in connection with FIG. 2. The usual seal 66 is provided on top of the stone 62 and then the interior of the concrete well casing is sealed with elastic concrete 68 and dirt as in FIGS. 2 and 3 so as to provide a barrier and seal against contaminating surface water or other contaminants entering the well installation. The plastic well casing 60 is provided with the same seal and lock as the installations of FIGS. 2 and 3 and again the water treatment pipe can be provided as described in the previous embodiments.

A simple, economical and easily installed well installation is shown for upgrading an existing prior art type of shallow well installation.

While a preferred embodiment has been described in the specification and illustrated in the drawings, it will be understood to those skilled in the art that various changes may be made and equivalents substituted without departing from the scope of the appended claims.

What is claimed is:

1. A shallow well structure for providing drinking water from a dug well bore having a diameter greater than one foot and a depth of less than fifty feet comprising:

a large diameter drinking water plastic pipe impervious to water and common earth organisms positioned in a dug well bore forming a well casing extending from above ground level to adjacent the foot of the well bore, said casing having a diameter less than the well bore in which it is to be installed;

said drinking water plastic pipe comprising at least two lengths of plastic water pipe each length having a male end and a female end coupling member adapted to receive therein in intimate sliding contact the male end of another length of pipe;

said coupling having an extended length so as to permit movement of one length of pipe relative to another length and forming a movable seal against entry of water or earth organisms to accommodate frost heaving and ground settling without breaking or impairing the integrity of said movable seal;

a plurality of small holes formed in the circumference of the bottom end of said large diameter plastic pipe;

a quantity of gravel surrounding said plastic pipe and extending from the bottom of the bore to above the water table level to support said pipe in said well bore and to filter through said gravel all the water drawn into said plastic pipe through said small circumferential holes;

a quantity of sealing material disposed about said well casing above said gravel, so as to fill and seal the well bore against entry of surface water or other foreign material;

a cover closing the top of said well casing; and a first small diameter pipe mounted inside said pipe well casing extending from adjacent the foot of the well to a pump member adjacent the head of said well casing for withdrawing water from the bottom of said well casing so that there is provided a fully filtered drinking water well, sealed against contamination from surface or sub-surface water, worms, other organisms, or chemical leaching.

2. A shallow well structure according to claim 1 including a second small diameter plastic water pipe inserted in said well bore outside said large diameter plastic pipe extending from above ground level to adjacent said small holes in the end or said drinking water plastic pipe, so that substantially direct access for treatment of the water being drawn into said large diameter drinking water plastic pipe is provided.

3. A shallow well structure according to claim 2 including a plurality of small holes formed in the bottom of said second small pipe; and a length of water treatment material positioned in the bottom of said second small diameter pipe so that water flowing into the bottom of said large diameter pipe will pass through the holes of said second small diameter pipe and dissolve a desired amount of water treatment material.

* * * * *